US009117599B2

(12) United States Patent
Chen et al.

(10) Patent No.: US 9,117,599 B2
(45) Date of Patent: Aug. 25, 2015

(54) SELF-GUIDED KEY SWITCH AND KEYBOARD CONFIGURED WITH SAME

(71) Applicants: DARFON ELECTRONICS (SUZHOU) CO., LTD., Suzhou, Jiangsu Province (CN); DARFON ELECTRONICS CORP., Gueishan Township, Taoyuan County (TW)

(72) Inventors: Fei-Ya Chen, Douliu (TW); Huang-Hsiao Kao, Taoyuan (TW)

(73) Assignees: DARFON ELECTRONICS (SUZHOU) CO., LTD., Suzhou, Jiangsu Province (CN); DARFON ELECTRONICS CORP., Gueishan Township, Taoyuan County (TW)

( * ) Notice: Subject to any disclaimer, the term of this patent is extended or adjusted under 35 U.S.C. 154(b) by 179 days.

(21) Appl. No.: 13/862,323

(22) Filed: Apr. 12, 2013

(65) Prior Publication Data

US 2014/0224632 A1 Aug. 14, 2014

(30) Foreign Application Priority Data

Feb. 8, 2013 (CN) ..... 2013 1 0050820

(51) Int. Cl.

| | |
|---|---|
| ***H01H 13/70*** | (2006.01) |
| ***H01H 3/12*** | (2006.01) |
| ***H01H 13/705*** | (2006.01) |

(52) U.S. Cl.

CPC ..... *H01H 3/12* (2013.01); *H01H 13/705* (2013.01); *H01H 2221/014* (2013.01); *H01H 2221/026* (2013.01); *H01H 2221/04* (2013.01)

(58) Field of Classification Search

USPC ..... 200/5 A, 344, 529, 533; 341/22, 34; 345/168

IPC ..... H01H 2221/04,2221/058, 2227/036

See application file for complete search history.

(56) References Cited

U.S. PATENT DOCUMENTS

| | | | | |
|---|---|---|---|---|
| 5,626,223 | A * | 5/1997 | Lee | 200/529 |
| 5,977,888 | A | 11/1999 | Fujita et al. | |
| 2012/0169603 | A1 | 7/2012 | Peterson et al. | |

FOREIGN PATENT DOCUMENTS

| | | | |
|---|---|---|---|
| CN | 101483111 | A | 7/2009 |
| CN | 202221714 | U | 5/2012 |
| JP | 8-235961 | A | 9/1996 |
| JP | 2000-113765 | A | 4/2000 |
| JP | 2007-173087 | A | 7/2007 |

* cited by examiner

*Primary Examiner* — Vanessa Girardi

(74) *Attorney, Agent, or Firm* — Cheng-Ju Chiang

(57) ABSTRACT

In a key switch, a base is disposed under a keycap. A frame has a receiving space for accommodating the keycap, and the receiving space is defined with a first dimension, a second dimension and a third dimension, and any two of the first, second and third dimensions are perpendicular to each other. A guiding mechanism is disposed between the keycap and the base, and configured to guide the keycap in response to an external force exerted on the keycap to move in substantially parallel to the frame with a first displacement in the first dimension, a second displacement in the second dimension and a third displacement in the third dimension.

23 Claims, 8 Drawing Sheets

SELF-GUIDED KEY SWITCH AND KEYBOARD CONFIGURED WITH SAME

TECHNICAL FIELD

The invention relates to a key switch, in particularly to a self-guided key switch. The invention also relates to a keyboard configured with a plurality of self-guided key switches.

BACKGROUND

A conventional computer keyboard is configured with a plurality of key switches, each of which moves straight down and then returns straight up in response to a user's push operation. For miniaturization, it is desired to reduce the overall thickness of the keyboard. Therefore, there would be limited travel distance for keystroke. However, thickness reduction over a certain level, for example, from 2 mm to 1 mm of the travel distance, will adversely affect the tactile recognition of a user while hitting the keys.

SUMMARY

The invention provides a key switch having a guiding mechanism for guiding the movement of a keycap of the key switch. The key switch has a reduced thickness compared to prior art while maintaining satisfactory tactile recognition for user.

The invention provides a key switch, which includes a keycap, a base disposed under the keycap, a frame having a receiving space for accommodating the keycap, and a guiding mechanism disposed between the keycap and the base. The receiving space is defined by an X-axis, a Y-axis and a Z-axis, and any two of the X-axis, and the Y-axis and the Z-axis being perpendicular to each other. The guiding mechanism is configured to maintain the keycap in a substantially level orientation parallel to a plane defined by the X-axis and the Y-axis and to guide the keycap to move along a moving path when the keycap is depressed to travel downward. The moving path is configured to impart a first displacement along the X-axis, a second displacement along the Y-axis and a third displacement along the Z-axis.

The invention also provides a key switch, which includes a base, a keycap disposed above the base, and a guiding mechanism. The keycap is movable between a first position and a second position relative to the base. The guiding mechanism includes at least one guiding groove and at least one protrusion. The protrusion has an arc shaped lateral surface facing the guiding groove. When exerted with an external force, the keycap moves from the first position to the second position by the guiding mechanism, and the arc shaped lateral surface of the protrusion and the guiding groove keep line contact with each other.

The invention further provides a keyboard, which includes a base; a first keycap disposed above the base and movable between a first position and a second position relative to the base; a first guiding mechanism moving the first keycap from the first position to the second position in response to a first external force exerted on the first keycap; a returning device disposed at a center position on an edge of the first keycap and configured for bringing the first keycap from the second position to the first position when the first external force exerted on the first keycap is released; a second keycap disposed above the base and movable between a third position and a fourth position relative to the base; a second guiding mechanism moving the second keycap from the third position to the fourth position in response to a second external force exerted on the second keycap; two confining mechanisms respectively disposed at two corners of the second keycap for confining a moving range of the second keycap; and a frame disposed around the first keycap and the second keycap and having a common portion extending between the first keycap and the second keycap, wherein the returning device is located between the two confining mechanisms within the common portion of the frame.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
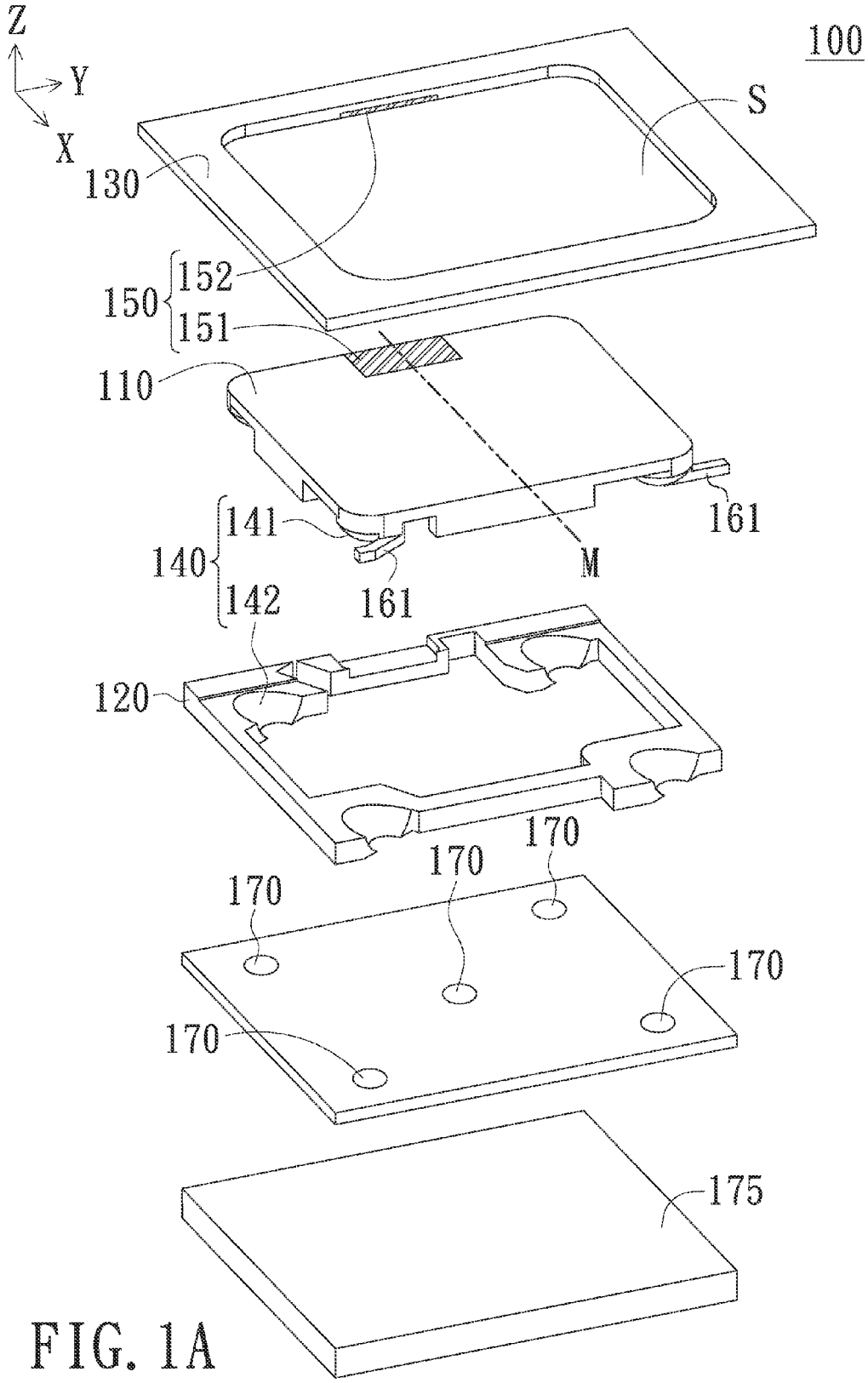
FIG. 1A schematically illustrates a top and exploded view of a key switch according to an embodiment of the invention.
Figure 1B:
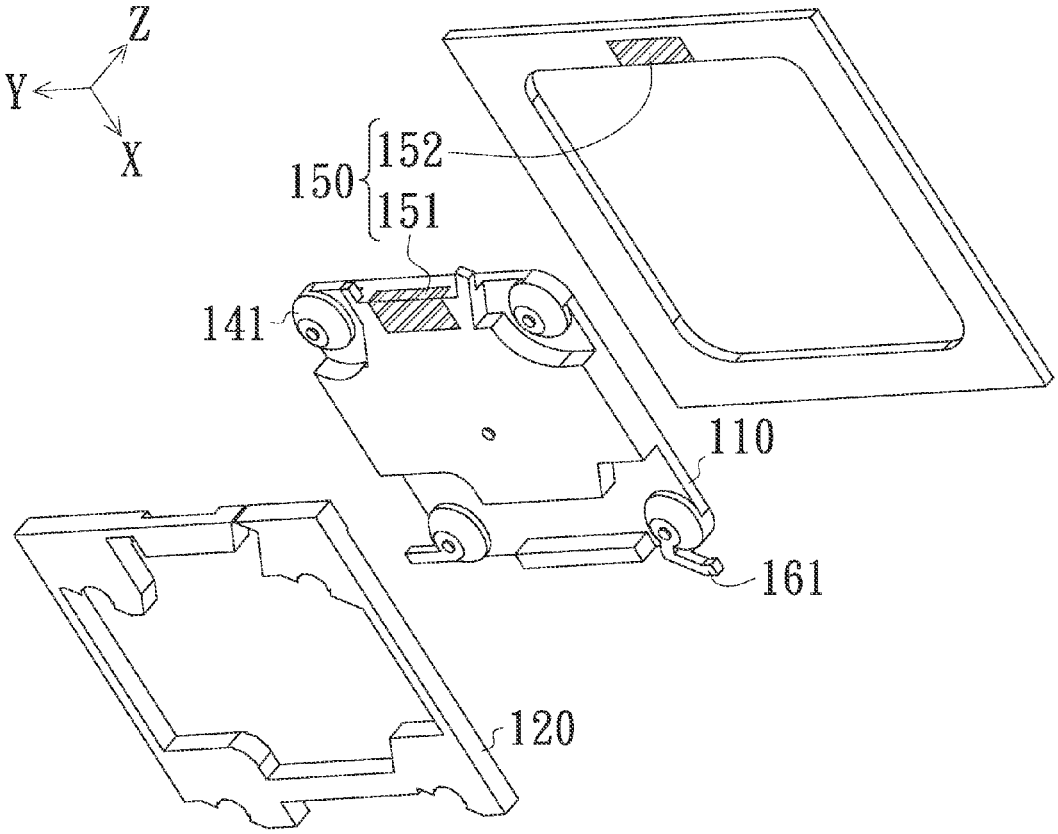
FIG. 1B schematically illustrates a bottom and exploded view of the key switch shown in FIG. 1A, while some components are omitted from illustration herein.

A first embodiment of the invention will be described hereinafter with reference to FIGS. 1A~1C. FIG. 1A and FIG. 1B schematically illustrate a disassembled key switch 100 in top view and a bottom view, respectively. The key switch 100 shown in FIG. 1A includes a keycap 110, a base 120, a frame 130, a guiding mechanism 140, a returning device 150, a switch device 170 and a bottom plate 175. On the other hand, FIG. 1B shows only a part of the key switch 100 including the keycap 110, the base 120 and the frame 130. The keycap 110 is movably accommodated in a receiving space S of the frame 130. The keycap 110 is further disposed on the base 120. The guiding mechanism 140 is arranged between the keycap 110 and the base 120 for guiding the keycap 110 to move relative to the frame 130 and the base 120 in response to a pushed operation of a user on the keycap 110. The returning device 150 is arranged between the keycap 110 and the frame 130 for bringing the pressed keycap 110 back to its initial position. The base 120 in this embodiment is hollow and the switch device 170 is disposed under the base 120 and triggered to generate and transmit a signal to associated circuit due to the guided movement of the keycap 110. The bottom plate 175 is disposed under the above mentioned components as a support.

In this embodiment, the guiding mechanism 140 includes four sliding members 141 arranged around four corners of the keycap 110, respectively, and four guiding grooves 142 arranged around four corners of the base 120 and coupled with the four sliding members 141, respectively. It is to be noted that the number of the pairs of sliding members 141 and guiding grooves 142 is not limited to four, which is only an example, and can be more or less depending on practical designs. In this embodiment, each of the sliding members 141 has at least an arc protrusion. For example, the sliding member 141 can be substantially ball-shaped. The obliquity of the guiding grooves 142 are configured the same, and preferably, have similar or substantially the same slope distribution. When the keycap 110 is depressed by a user to travel downward, the sliding members 141 downwardly slide along corresponding guiding grooves 142 so that the keycap 110 obliquely moves toward the base 120 in a parallel and stable manner. In other words, the keycap 110 is maintained in a substantially level orientation parallel to a plane defined by the X-axis and the Y-axis. The plurality of sliding members 141 are always positioned at substantially the same height when the keycap 110 moves downward. The returning device 150 includes a first magnetic member 151 disposed in the keycap 110 and a second magnetic member 152 disposed in the frame 130 at corresponding positions. The first magnetic member 151 and the second magnetic member 152 are made to attract each other all the time. For example, they can be two magnets with different polarities. Alternatively, one is a ferromagnetic piece and the other is a magnet.

Optionally, the key switch 100 may further include a backlight module (not shown) disposed under the base 120. By arranging the keycap 110 with a transparent region, the light emitted from the backlight module can penetrate the keycap 110 so as to light up the key switch 100 and facilitate the user's operations.

Referring to FIGS. 1A and 1B, in this embodiment, the sliding member 141 of the keycap 110 has a convex arc shaped lateral surface, and the guiding groove 142 has a concave arc shaped lateral surface. The radius of curvature of the guiding groove 142 is preferably equal to or larger than the radius of curvature of the corresponding sliding member 141 so as to accommodate the sliding member 141 smoothly in the guiding groove 142. FIG. 1C schematically illustrates a configuration of the guiding groove 142. When the keycap 110 is depressed by a user to travel downward, the sliding member 141 can smoothly move in the guiding groove 142 along the moving path N1. Since the guiding groove 142 obliquely extends downwards at angles with adjacent sides of the base 120, it is clear that the movement along the moving path N1 simultaneously involves displacements in X-, Y- and Z-axes.

Figure 1C:
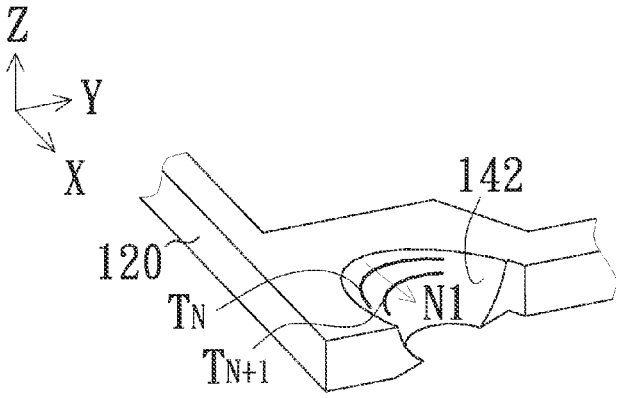
FIG. 1C schematically illustrates a partial and enlarged view of a guiding mechanism of the key switch as illustrated in FIG. 1, including a guiding groove.

As shown in FIG. 1C, if the radius of curvature of the guiding groove 142 is equal to the radius of curvature of the ball-shaped sliding member 141, the guiding groove 142 and the sliding member 141 will contact with each other with an arc contact line TN. The maximal length of the contact line TN will be half a circumference of the ball-shaped sliding member 141. As the sliding member 141 slides in the guiding groove 142, the contact line moves therealong, for example to another contact line TN+1 at a specified time point. The contact lines TN and TN+1 are substantially parallel to each other and to the bottom of the base 120. In other words, the sliding member 141 and the guiding groove 142 keep line contact with each other all through the path N1.

On the other hand, if the radius of curvature of the guiding groove 142 is larger than the radius of the curvature of the sliding member 141, the guiding groove 142 still has an arc contact line in contact with the sliding member 141. However, the lengths of the contact lines TN and TN+1 would be shorter than those in the case of equal radius of curvature. For example, the sliding member 141 and the guiding groove 142 may have a length of contact line of about quarter a circumference of the ball-shaped sliding member 141 or less, or just in point contact with each other. It is understood that the shorter the line contact between the sliding member 141 and the guiding groove 142, the less significant the friction therebetween. Therefore, good balance between guiding stability and smooth movement would be one of the design issues.

Take the case that the radius of curvature of the guiding groove 142 is equal to the radius of the curvature of the sliding member 141 as an example. The travel distance of the keycap 110 is substantially equal to the movement distance of the sliding member 141 in the guiding groove 142 along the path N1. Assuming the movement of the keycap 110 along the path N1 results in a displacement of 0.7 mm in the X-axis direction, a displacement of 0.4 mm in the Y-axis direction, and a displacement of 0.7 mm in the Z-axis direction, the travel distance of about 1.1 mm ($(((0.4)^2+(0.7)^2+(0.7)^2)^{1/2}=1.06)$ can be obtained, which is significantly greater than 0.7 mm in the Z-axis direction in prior art. Accordingly, the tactile recognition of a user can be improved while the thickness of the key switch can be reduced compared to conventional key switches.

In this embodiment, the moving path of the sliding member 141 is linear, as indicated by the reference N1. Alternatively, by changing the shape or configuration of the guiding groove 142, e.g. into a curve line, the moving path N1 of the sliding member 141 can be made tortuous so as to further enhance the tactile recognition.

Figure 2A:
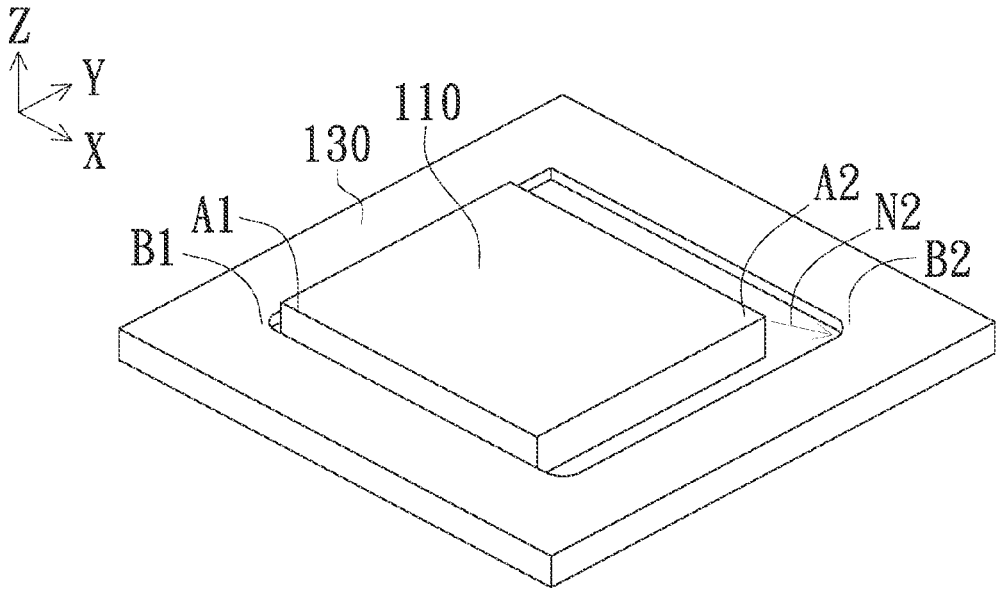
FIG. 2A schematically illustrates a perspective view of a key switch according to an embodiment of the invention.
Figure 2B:
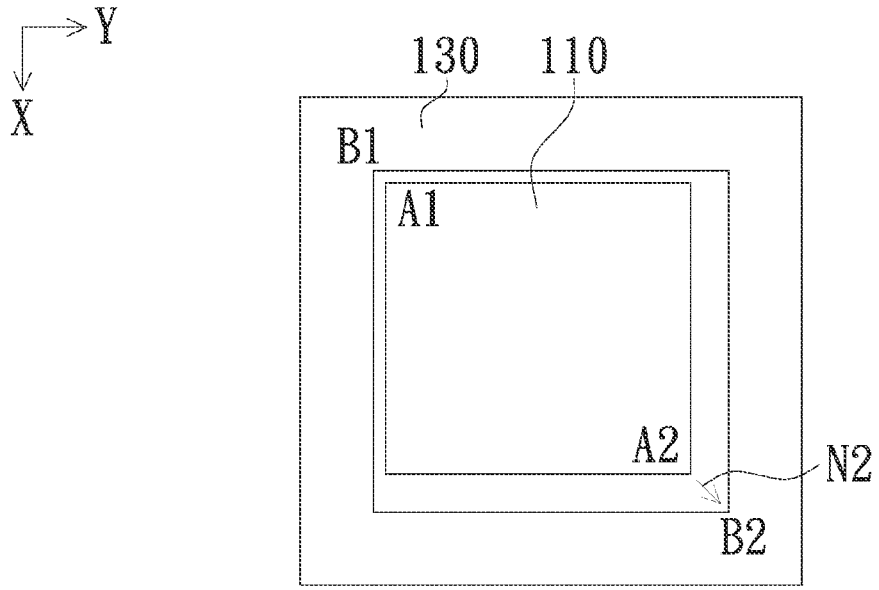
FIG. 2B schematically illustrates a top plane view of the key switch shown in FIG. 2A in an original state.
Figure 2C:
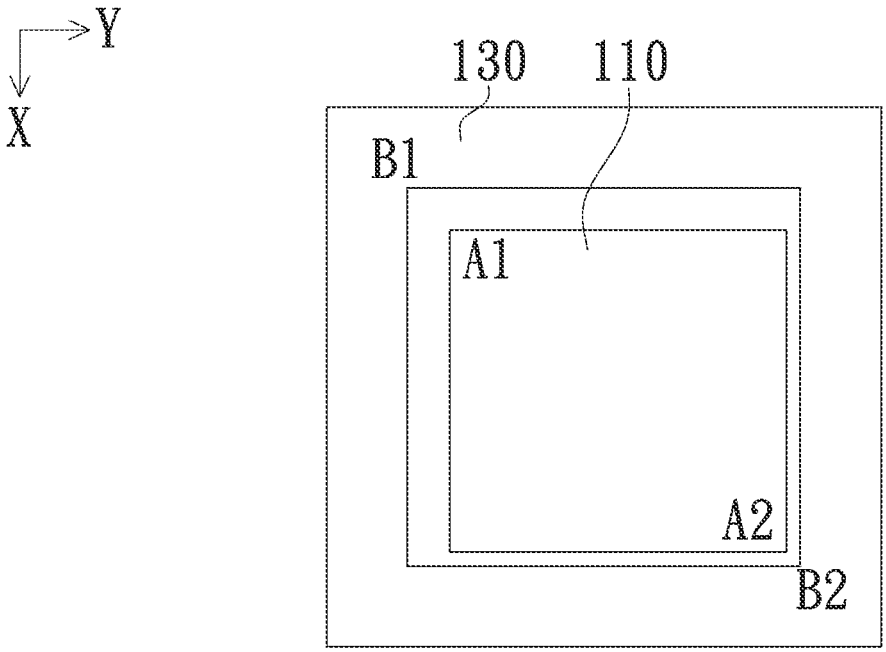
FIG. 2C schematically illustrates a top plane view of the key switch shown in FIG. 2A in a pushed state.

Hereinafter, the movement of a keycap of a key switch by way of a guiding mechanism according to the invention will be described. FIGS. 2A~2C schematically illustrate an embodiment of the assembly of the key switch. The configuration of the key switch can be identical to that shown in FIGS. 1A~1C, or any other configuration feasible to accomplish the movement as shown. In this embodiment, the key switch 100 as shown in FIGS. 1A~1C is used for exemplification. FIG. 2B illustrates an original state of the key switch that has not been pressed yet, and FIG. 2C illustrates a pushed state of the key switch that is depressed. As shown, the receiving space of the frame 130 for accommodating the keycap 110 is configured to be larger than the dimensions of the keycap 110 in both X- and Y-axes. For example, the frame 130 has a first dimension along the X-axis and a second dimension along the Y-axis. The keycap 110 has a first dimension along the X-axis and a second dimension in the Y-axis. The first dimension of the frame 130 is larger than the first dimension of the keycap 110, and the second dimension of the frame 130 is larger than the second dimension of the keycap 110, whereby the keycap 110 is movable in the receiving space along both the X-axis and Y-axis. As shown in FIG. 2B when the keycap 110 has not been pressed by the user, the keycap 110 is at a first position, where the keycap 110 is located at a highest level relative to the frame 130 and a corner A1 of the keycap 110 is close to a corner B1 of the frame 130. As shown in FIG. 2C, after the keycap 110 is depressed by the user, the keycap 110 moves to a second position through the use of the guiding mechanism, where the keycap 110 is located at a lowest level relative to the frame 130, and an opposite corner A2 of the keycap 110 is close to an opposite corner B2 of the frame 130. Assuming the corner A2 of keycap 110 as a reference point, the reference point has coordinates (x1, y1, z1) when the keycap 110 is at the first position, and coordinates (x2, y2, z2) when the keycap 110 is at the second position. A trace from coordinates (x1, y1, z1) to coordinates (x2, y2, z2) is denoted as N2. Since the sliding member 141 and the keycap 110 have the same moving path, they have the same displacement. In other words, in case the moving path N1 of the sliding member 141 is a straight line, a vector of the moving path N1 from a start point to an end point is parallel to that of N2 (the reference point moving from coordinates (x1, y1, z1) to coordinates (x2, y2, z2)). In case the path N1 is a curve line, the displacement of the moving path N1 from a start point to an end point is equal to the length of N2 (the reference point moving from coordinates (x1, y1, z1) to coordinates (x2, y2, z2)).

Figure 3A:
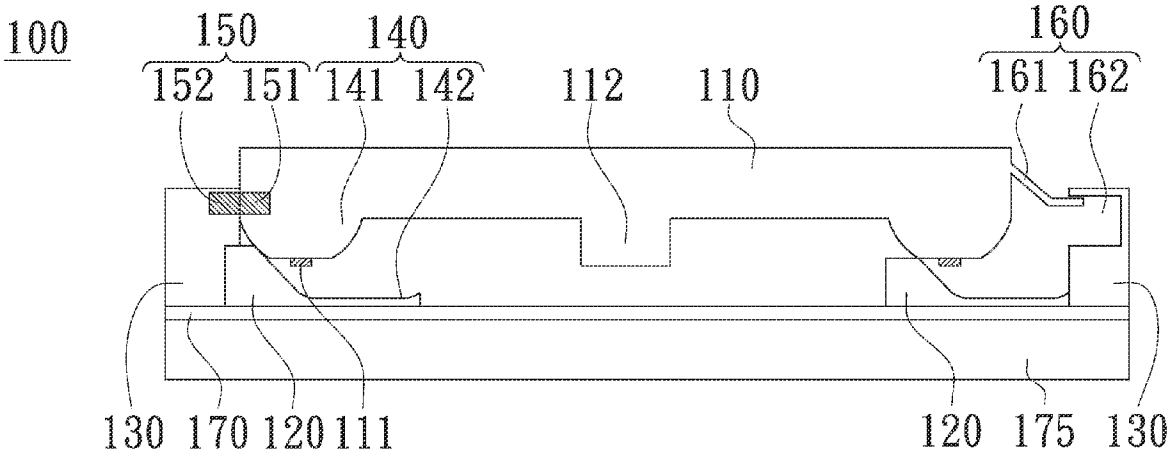
FIG. 3A schematically illustrates a cross-sectional view of a key switch according to an embodiment of the present invention in an original state.
Figure 3B:
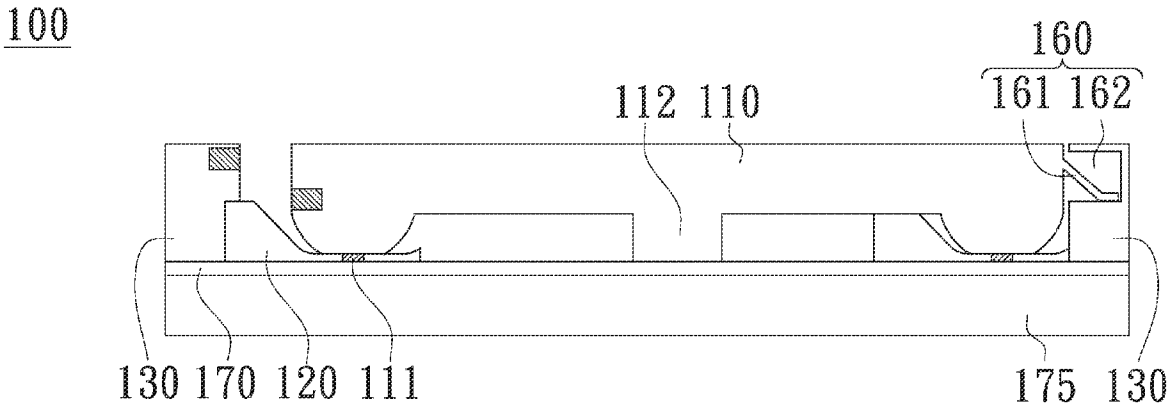
FIG. 3B schematically illustrates a cross-sectional view of the key switch shown in FIG. 3A in a pushed state.

FIG. 3A illustrates a cross-sectional view of a key switch according to an embodiment of the present invention in an original state. FIG. 3B illustrates a cross-sectional view of the key switch shown in FIG. 3A in a pushed state. Referring to FIGS. 2A, 2B, 3A and 3B, the first magnetic member 151 is disposed in the keycap 110, and the second magnetic member 152 is disposed in the frame 130. When the key switch 100 is in the original state, the returning device 150 attaches the keycap 110 to the frame 130 and remains the keycap 110 at the first position (as shown in FIGS. 3A and 2B). After the key switch 100 is depressed, the keycap 110 is moved to the second position through the use of the guiding mechanism 140 (as shown in FIGS. 3B and 2C). In the moving process, the sliding member 141 and the guiding groove 142 keep line contact with each other. As those cross-sectional views show, the arc-shaped lateral surface of the sliding member 141 seems to contacts with the guiding groove 142 only at a single point. After the external force exerted on the keycap 110 is released, the attraction force from the returning device 150 will bring the keycap 110 back to the first position (as shown in FIGS. 3A and 2B).

Referring to FIGS. 3A and 3B, the key switch 100 further includes a confining mechanism 160. The confining mechanism 160 includes a plurality of protruding members 161 and a plurality of recesses 162. The protruding members 161 are located around the keycap 110 and extend outwardly from edges of the keycap 110. The recesses 162 are located on the frame 130 corresponding to the protruding members 161. The dimensions of each of the recesses 162 are larger than that of the corresponding protruding member 161. No matter whether the keycap 110 is at the first position (as shown in FIG. 3A) or the second position (as shown in FIG. 3B) relative to the base 120, the protruding member 161 keeps staying in the corresponding recess 162 so as to constrain the keycap 110 inside the frame and avoid the keycap 110 from escaping from the frame 130.

Figure 4A:
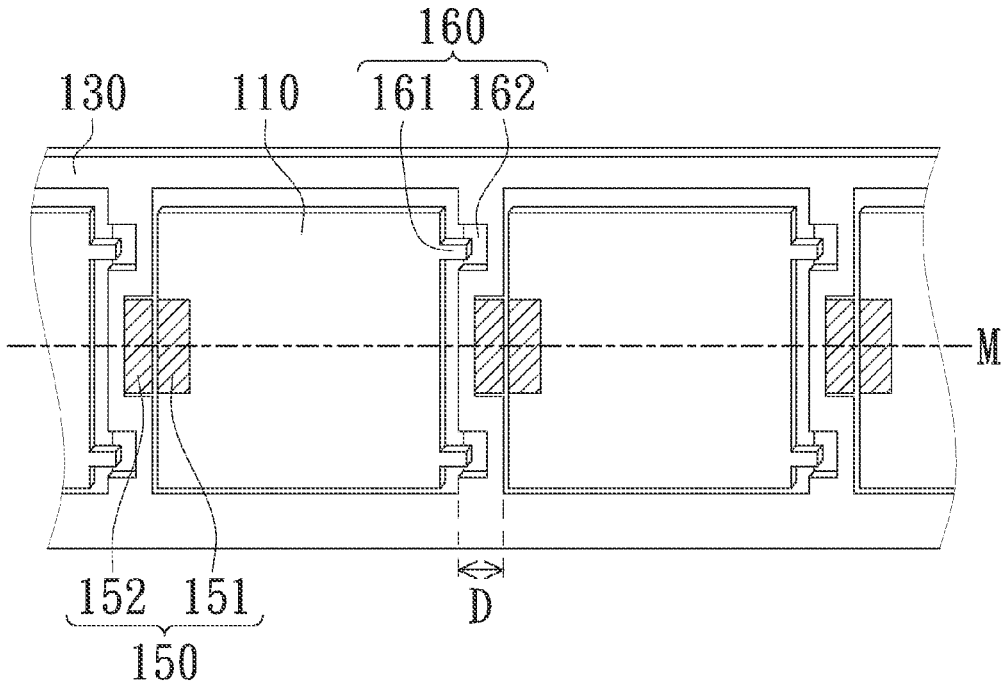
FIG. 4A is a schematic top plane view of a part of a keyboard according to an embodiment of the invention.
Figure 4B:
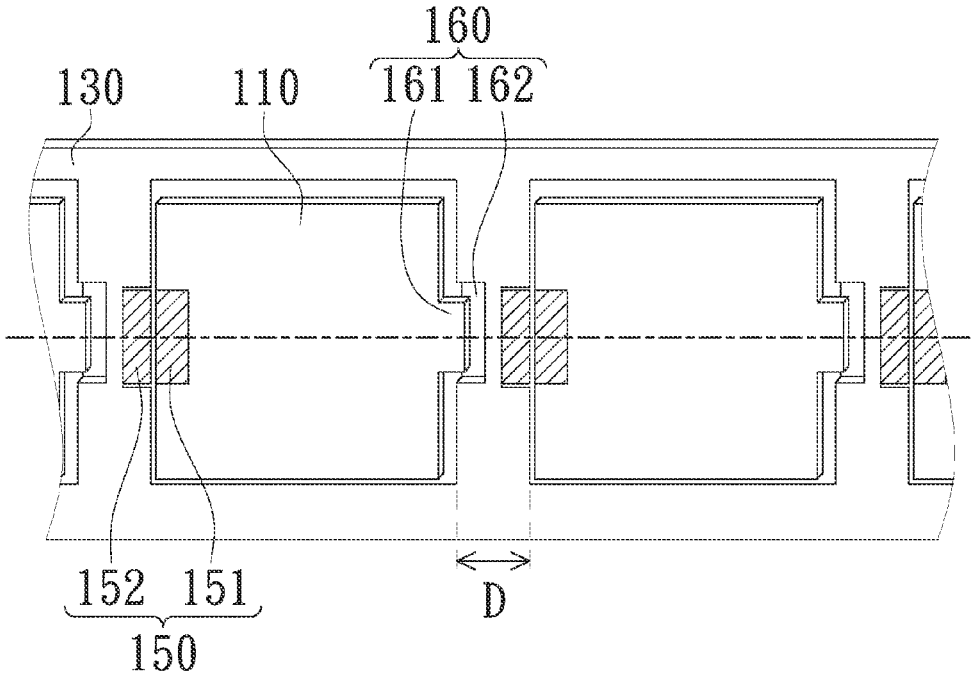
FIG. 4B is a schematic top plane view of a part of a keyboard according to another embodiment of the invention.

In this embodiment, as FIG. 1A shows, the returning device 150 is disposed close to a horizontal line M crossing the geometric center of the keycap 110. The protruding members 161 of the confining mechanism 160 are disposed at two corners of the keycap 110. As shown in FIG. 4A, when there is a need to densely arrange a plurality of the key switches 100 together to function as a keyboard, for example. Two confining mechanisms 160 of a key switch in the left side and a returning device 150 of a key switch in the right side can be arranged at different locations on a vertical common portion of the frame 130 extending between the two key switches. More specifically, the returning device 150 of the key switch in the right side is located between the two recesses 162 of the confining mechanisms 160 of the key switch at the left side. The frame 130 is used more economically, and thus the distance D between the two key switches can be reduced. It is to be noted that the locations and the number of the protruding members of the invention are not limited, in other embodiments, as shown in FIG. 4B, if the space on the common portion of the frame 130 is sufficient and the distance D between the two key switches is larger, the locations and the number of the protruding members can be adjusted according to practical demands. For example, the returning device 150 (including the first magnetic member 151 and the second magnetic member 152) and the confining mechanism 160 (including protruding member 161 and the recess 162) can be both arranged along the horizontal line M crossing the geometric center of the keycap 110.

As can be seen in FIGS. 3A and 3B, a switch device 170 is disposed under the base 120. As shown in the drawings, the sliding member 141 is a portion cut from a sphere so as to further reduce the height of the key switch 100. As long as the sliding member 141 has at least a part of arc shaped lateral surface, the sliding member 141 can smoothly slide in the guiding groove 142. The sliding member 141 has a bump 111 on its bottom surface. When the keycap 110 moves to the second position (as shown in FIG. 3B), the bump 111 pushes the switch device 170 to send signals. In this embodiment, except for the bumps 111 arranged on the sliding members 141 at the four corners of the keycap 110, a larger bump 112 is arranged at the center of the lower surface of the keycap 110 for pushing another switch device 170. Accordingly, as shown in FIG. 1A, the key switch 100 has five switch devices 170 corresponding to the bumps 111 and 112 as contacting points. Each of the switch devices 170 can be triggered individually by a corresponding bump. If force exerted on the keycap 110 is not uniform to push all of the switch devices 170, as long as only one switch is triggered, the electronic signal representing the key switch 100 can be sent out.

Figure 5A:
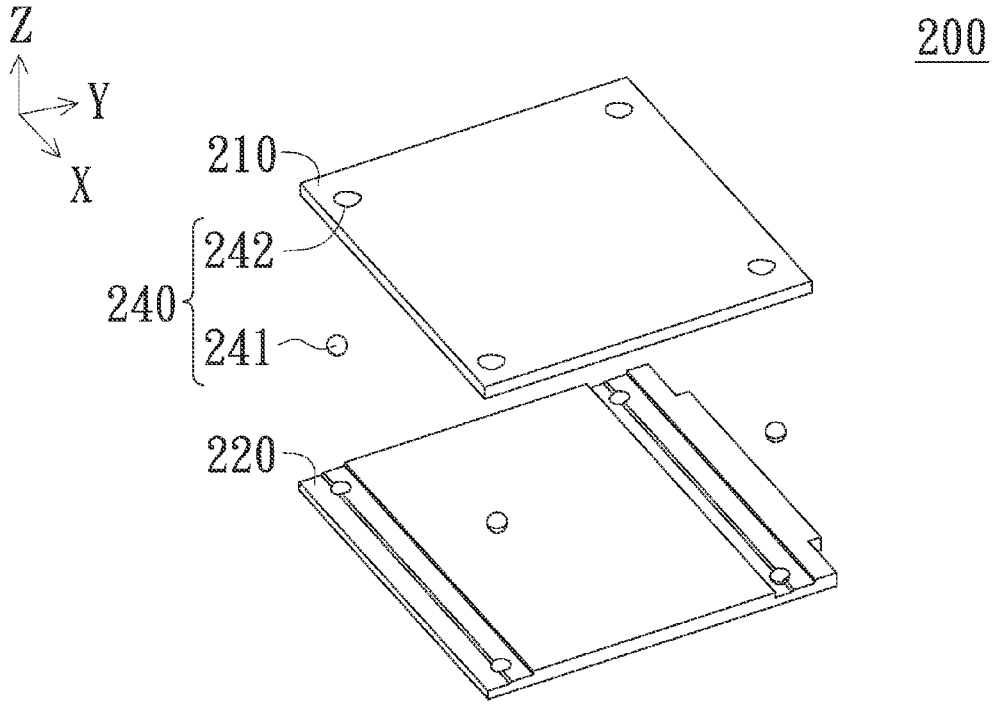
FIG. 5A is a top and exploded view schematically illustrating a guiding mechanism of a key switch according to another embodiment of the invention.
Figure 5B:
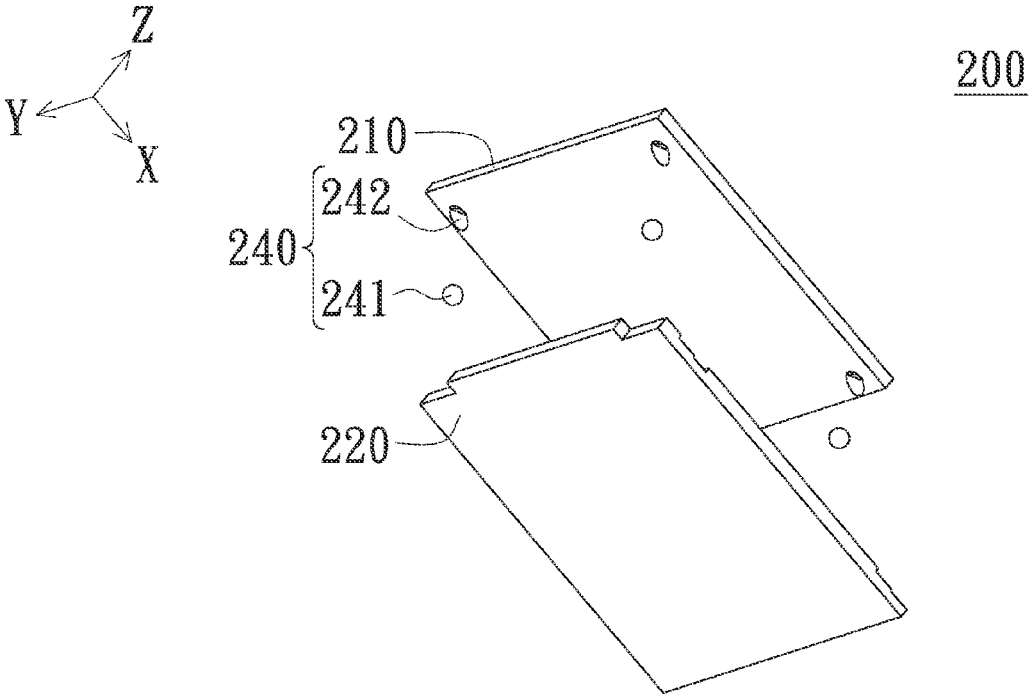
FIG. 5B illustrates a bottom and exploded view schematically illustrating the guiding mechanism shown in FIG. 5A.
Figure 5C:
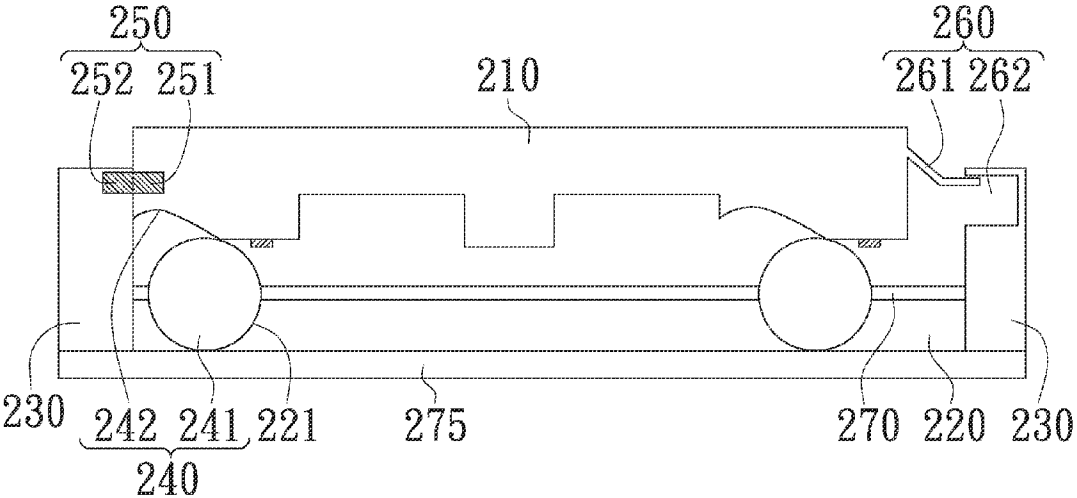
FIG. 5C schematically illustrates a cross-sectional view of the key switch shown in FIG. 5A in an original state.
Figure 5D:
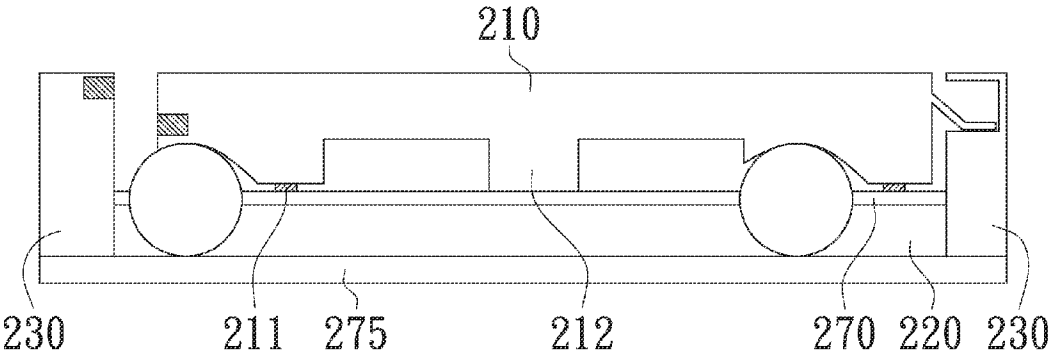
FIG. 5D schematically illustrates a cross-sectional view of the key switch shown in FIG. 5A in a pushed state.

FIG. 5A illustrates an exploded view top and exploded view schematically illustrating a guiding mechanism of a key switch according to a second embodiment of the invention. FIG. 5B illustrates a bottom and exploded view schematically illustrating the guiding mechanism shown in FIG. 5A. FIG. 5C schematically illustrates a cross-sectional view of the key switch shown in FIG. 5A in an original state; and FIG. 5D schematically illustrates a cross-sectional view of the key switch shown in FIG. 5A in a pushed state. Referring to FIGS. 5A~5D, the difference between the key switch 200 in this embodiment and the key switch 100 in the first embodiment is that the guiding groove 242 of the guiding mechanism 240 is arranged on the keycap 210, and the sliding member 241 is arranged on the base 220. The structures and functions of the other components are the same as that in the first embodiment and thus not repeated hereinafter. In this embodiment, the sliding members 241 are, for example, steel balls, which can be detached from the base 220. The keycap, the sliding member and the base are components that are made individually. A plurality of recesses 221 are correspondingly formed on the lower surface of the base 220. Accordingly, the sliding member 241 rolls against the guiding groove 242, the friction therebetween can be further lowered.

Besides, as shown in FIGS. 5C~5D, a plurality of bumps 211 can be disposed adjacent to the four guiding grooves 242, and a bump 212 can be disposed at the center of the lower surface of the keycap 210. Similar to the switch devices 170 shown in FIG. 1A, the key switch 200 includes five switch devices 270 which each can be triggered individually. Accordingly, the key switch 200 has five switch devices 270 as contacting points for contacting with the corresponding bumps 211, 212.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key switch, comprising:

a base;

a keycap disposed above the base and movable between a first position and a second position relative to the base; and a guiding mechanism comprising at least one guiding groove and at least one protrusion, wherein the protrusion has an arc shaped lateral surface facing the guiding groove;

a confining mechanism and a frame, the frame having a receiving space, wherein the keycap is placed within the receiving space and the confining mechanism is configured to constrain the keycap within the receiving space, wherein the confining mechanism includes at least one protruding member and at least one recess;

wherein the protruding member is disposed at a corner of the keycap, and the recess is disposed on the frame and coupled with the protruding member;

wherein when exerted with an external force, the keycap moves from the first position to the second position by the guiding mechanism, and the arc shaped lateral surface of the protrusion and the guiding groove keep a line contact with each other.

2. A key switch, comprising:

a base;

a keycap disposed above the base and movable between a first position and a second position relative to the base;

a guiding mechanism comprising at least one guiding groove and at least one protrusion, wherein the protrusion has an arc shaped lateral surface facing the guiding groove;

a returning device for bringing the keycap from the second position to the first position when the external force is released; and a frame disposed around the keycap, wherein the returning device includes a first magnetic member disposed on the keycap and a second magnetic member disposed on the frame and coupled with the first magnetic member;

wherein when exerted with an external force, the keycap moves from the first position to the second position by the guiding mechanism, and the arc shaped lateral surface of the protrusion and the guiding groove keep a line contact with each other.

3. The key switch as recited in claim 2, wherein the first magnetic member and the second magnetic member are two magnets with different polarities.

4. The key switch as recited in claim 2, wherein the first magnetic member and the second magnetic member are one ferromagnetic piece and one magnet.

5. A keyboard, comprising:

a base;

a first keycap disposed above the base and movable between a first position and a second position relative to the base;

a first guiding mechanism moving the first keycap from the first position to the second position in response to a first external force exerted on the first keycap;

a returning device disposed at a center position on an edge of the first keycap and configured for bringing the first keycap from the second position to the first position when the first external force exerted on the first keycap is released;

a second keycap disposed above the base and movable between a third position and a fourth position relative to the base;

a second guiding mechanism moving the second keycap from the third position to the fourth position in response to a second external force exerted on the second keycap;

two confining mechanisms respectively disposed at two corners of the second keycap for confining a moving range of the second keycap; and a frame disposed around the first keycap and the second keycap and having a common portion extending between the first keycap and the second keycap, wherein the returning device is located between the two confining mechanisms within the common portion of the frame.

6. The keyboard as recited in claim 5, wherein each of the second confining mechanisms includes a second protruding member and a second recess, the second protruding member is disposed at a corner of the second keycap, and the second recess is disposed within the common portion and coupled with the second protruding member, and the first returning device is located between the two second recesses.

7. The keyboard as recited in claim 5, further comprising:

two confining mechanisms respectively disposed at two corners of the first keycap for confining a moving range of the first keycap; and a returning device disposed at a center position on an edge of the second keycap and configured for bringing the second keycap from the second position to the first position when the second external force exerted on the second keycap is released.

8. A key switch, comprising:

a keycap;

a base disposed under the keycap;

a frame having a receiving space for accommodating the keycap, the receiving space being defined by an X-axis, a Y-axis and a Z-axis, and any two of the X-axis, the Y-axis and the Z-axis being perpendicular to each other; and a guiding mechanism disposed between the keycap and the base, and configured to maintain the keycap in a substantially level orientation parallel to a plane defined by the X-axis and the Y-axis and to guide the keycap to move along a moving path when the keycap is depressed to travel downward;

wherein the moving path is configured to impart a first displacement along the X-axis, a second displacement along the Y-axis and a third displacement along the Z-axis;

wherein a geometric center of the keycap in terms of an X-Y plane defines a center point, and the keycap is capable to move between a first position and a second position when the keycap is guided along the moving path, the center point is located at the coordinate (x1, y1, z1) when the keycap is positioned at the first position, the center point is located at the coordinate (x2, y2, z2) when the keycap is positioned at the second position, x1 is different from x2, y1 is different from y2, and z1 is different from z2.

9. The key switch as recited in claim 8, wherein the moving path starts from the coordinate (x1, y1, z1) and ends at the coordinate (x2, y2, z2), and the moving path is a straight line extending between the coordinate (x1, y1, z1) and the coordinate (x2, y2, z2).

10. The key switch as recited in claim 8, wherein the moving path has a starting point and an end point, the moving path is a curve line extending between the starting point and the end point.

11. The key switch as recited in claim 8, wherein the guiding mechanism comprising a plurality of guiding grooves and a plurality of sliding members, the plurality of guiding grooves are formed on the base, the plurality of sliding members are disposed on the keycap, and the obliquity of the plurality of guiding grooves are configured substantially the same, so that the plurality of sliding members are always positioned at substantially the same height when the keycap moves downward, and the keycap is maintained in the substantially level orientation parallel to the plane defined by the X-axis and the Y-axis.

12. The key switch as recited in claim 8, wherein the guiding mechanism comprising a guiding groove disposed on the base and a sliding member disposed on the keycap and operated with the guiding groove, and the guiding groove is dimensioned to match the sliding member so that the sliding member can only move along the moving path when the sliding member moves within the guiding groove.

13. The key switch as recited in claim 8, wherein the guiding mechanism comprising a plurality of guiding grooves and a plurality of sliding members, the plurality of guiding grooves are formed on the keycap, the plurality of sliding members are disposed on the base, and the obliquity of the plurality of guiding grooves are configured substantially the same, so that the plurality of guiding grooves are positioned at substantially the same height when the keycap moves downward, and the keycap is maintained in a substantially level orientation parallel to the plane defined by the X-axis and the Y-axis.

14. The key switch as recited in claim 8, wherein the guiding mechanism comprises a guiding groove disposed on the keycap and a sliding member disposed on the base, and the sliding member is coupled with the guiding groove, and the guiding groove is dimensioned to match the sliding member so that the sliding member can only move along the moving path when the sliding member moves within the guiding groove.

15. The key switch as recited in claim 8, wherein the dimension of the keycap along the X-axis is less than the dimension of the receiving space along the X-axis, and the dimension of the keycap along the Y-axis is less than the dimension of the receiving space along the Y-axis, and the guiding mechanism is configured to move the keycap in the receiving space along both the X-axis and Y-axis when an external force is exerted on the keycap along the Z-axis.

16. The key switch as recited in claim 8, wherein the guiding mechanism comprises at least one guiding groove and at least one protrusion, and the protrusion has an arc shaped lateral surface facing the guiding groove;

wherein when exerted with an external force, the keycap moves from the first position to the second position by the guiding mechanism, and the arc shaped lateral surface of the protrusion and the guiding groove keep line contact with each other.

17. The key switch as recited in claim 16, wherein the protrusion is disposed on the keycap and the guiding groove is disposed on the base.

18. The key switch as recited in claim 16, wherein the guiding groove is disposed on the keycap and the protrusion is disposed on the base.

19. The key switch as recited in claim 16, wherein the arc shaped lateral surface is a portion cut from a spherical surface.

20. The key switch as recited in claim 16, further comprising a returning device for bringing the keycap from the second position to the first position when the external force is released.

21. The key switch as recited in claim 16, further comprising a switch device disposed under the keycap and triggered when the keycap moves to the second position.

22. The key switch as recited in claim 16, further comprising a confining mechanism and a frame, the frame having a receiving space, wherein the keycap is placed within the receiving space and the confining mechanism is configured to constrain the keycap within the receiving space.

23. The key switch as recited in claim 22, wherein the confining mechanism includes at least one protruding member and at least one recess.

* * * * *